United States Patent [19]

Scholl et al.

[11] 4,006,845

[45] Feb. 8, 1977

[54] MOLTEN ADHESIVE DISPENSING DEVICE

[75] Inventors: Charles H. Scholl, Vermilion; Alan B. Reighard, Bay Village, both of Ohio

[73] Assignee: Nordson Corporation, Amherst, Ohio

[22] Filed: Apr. 7, 1975

[21] Appl. No.: 565,733

[52] U.S. Cl. ..... 222/146 HE; 165/156; 401/2

[51] Int. Cl.[2] ..... B67D 5/62

[58] Field of Search ..... 222/146 HE, 465; 165/184, 156; 401/1, 2

[56] References Cited

UNITED STATES PATENTS

| | | | |
|---|---|---|---|
| 2,341,319 | 2/1944 | Graham et al. | 165/156 |
| 2,778,530 | 1/1957 | Sillars | 222/146 HE |
| 2,790,679 | 4/1957 | Martindale | 222/146 HE |
| 3,221,937 | 12/1965 | Kamborian | 222/146 HE X |
| 3,485,417 | 12/1969 | Cocks | 222/146 HE |
| 3,582,613 | 6/1971 | Pies | 222/146 HE X |
| 3,718,805 | 2/1973 | Posey | 22/146 HE X |
| 3,864,045 | 4/1975 | Hudson | 401/1 |
| 3,942,687 | 3/1976 | Walus | 222/146 HE |

FOREIGN PATENTS OR APPLICATIONS

| | | |
|---|---|---|
| 1,392,285 | 4/1975 | United Kingdom |

*Primary Examiner*—Stanley H. Tollberg
*Assistant Examiner*—Hadd Lane
*Attorney, Agent, or Firm*—Wood, Herron & Evans

[57] ABSTRACT

A novel handle structure, and a novel heat exchanger structure, for a hand-held adhesive gun of the type adapted to discharge a heated thermoplastic adhesive through a discharge valve located in the gun's barrel. In preferred form, the novel handle structure is positioned at the aft end of the gun's barrel, and has a longitudinal axis extending rearwardly of the gun's barrel and located at an acute angle relative to the longitudinal axis of the gun's barrel. The gun's handle is positionable about the gun barrel's longitudinal axis between at least two operating locations, one being positioned 180° from the other. A gun control switch is mounted interiorly of the handle, the switch being mechanically operated by the gun's trigger. At least two ports are provided in the handle, one at the foot of the handle and the other adjacent the gun's barrel, the power cord that interconnects with the gun control switch being receivable into the handle through either port depending on the use orientation of the handle. Also in preferred form, the novel heat exchanger includes a heat exchanger core fixed in location within a heater body's bore. The heat exchanger core has spiral threads on the outer surface thereof, and the bore's surface has spiral threads thereon, too. The heat exchanger core's threads are sized relative to the inlet bore's threads such that the core can be threaded into the bore, and such that the threads cooperate to define a spiral path about the core through the bore from one end to the other, thereby defining a spiral heat exchange path through the gun's heater body. This novel heat exchanger is particularly adapted to elevate the temperature of the molten adhesive, just prior to dispensing it, above that temperature level at which the molten adhesive is supplied to the hand gun.

11 Claims, 9 Drawing Figures

MOLTEN ADHESIVE DISPENSING DEVICE

This invention relates to a thermoplastic adhesive dispensing device. More particularly, this invention relates to a novel handle structure and a novel heat exchanger device for a thermoplastic adhesive dispensing device, that device being generally configured in the form of a hand gun.

Hot melt adhesives, i.e., adhesives of the thermoplastic type, have recently become quite commonplace in certain industries. For example, same are widely used in the assembly and manufacture of automobiles, furniture, aircraft sub-assemblies, and the like. Of course, assembly operations in these industries utilize production line techniques, and in that type of assembly where the adhesive applicator cannot remain stationary, i.e., where the operator must have freedom to move the applicator in and out or back and forth as required, a hand gun type of adhesive applicator device is used. However, efficiency on the part of the operator utilizing the hot melt adhesive hand gun is highly desirable. It is important, therefore, that the adhesive gun be easy to use by the operator without unduly tiring the operator over a regular work day.

A hand-held adhesive applicator device is generally referred to as a gun because of its overall similarity to a hand gun in both configuration and operation. Each such gun is generally provided with a pistol grip or handle portion, a generally barrel-shaped portion that houses the discharge valve for the adhesive, and a trigger device by means of which operation of the gun is controlled, i.e., by means of which molten adhesive discharge is controlled.

There are two basic systems for supplying thermoplastic or hot melt adhesive to the discharge valve in such a hand gun device. The first system requires an extruder type structure incorporated in the gun's barrel to translate, within the hand gun itself, solid feedstock (e.g., in pellet or slug form) into molten feedstock at the discharge valve. Such is accomplished by forcing the solid feedstock through a relatively high temperature heat exchanger in the gun's barrel, the force being provided by, e.g., a pneumatic motor supplied with air pressure through a power cord. An adhesive gun of this type is disclosed in U.S. Pat. No. 3,818,930, issued June 25, 1974, and assigned to the assignee of this application.

The second system of supplying molten adhesive feedstock to the gun's discharge valve is to transmit same in molten form to the gun through a feed hose from a separate supply source. In this system the molten feedstock is translated from solid state (e.g., pellets, bulk, billet or chunk) to molten state at a separate location by a melter structure separate from the hand gun itself. The molten feedstock is then pumped from the melter structure to the hand gun through the gun's molten adhesive feed hose. An adhesive gun adapted to function from an independent molten feedstock supply source in this manner is illustrated in U.S. Pat. No. 3,543,968, issued Dec. 1, 1970, and assigned to the assignee of this application. Independent supply systems for melting and forwarding thermoplastic adhesive material through a feed hose to a separate hand gun structure are illustrated in U.S. Pat. No. 3,815,788, issued June 11, 1974, and U.S. Pat. No. 3,827,603, issued Aug. 6, 1974, both assigned to the assignee of this application.

In the high speed assembly, or production line, situations such as occur in the automobile and furniture industries, it is oftentimes desirable to use that type adhesive gun structure which is supplied with molten feedstock from a separate molten source such as described in the second system above. This for the reason that same provides a large and substantially continuous supply of molten feedstock to the hand gun and, therefore, to the gun's operator. This precludes the necessity of continuously loading and reloading the gun with solid feedstock by the operator during use, such as is required in the first system described above. In production line situations that use a separate melter structure, that supply source of the molten feedstock, i.e., the reservoir of molten feedstock, is incorporated in a large housing (relative to the size of the hand-held adhesive gun) at a location adjacent to the operator's work station. In some production line situations this molten feedstock reservoir is positioned on the floor or bench next to the operator's work station. In other production line situations, it may be more convenient to support the molten feedstock hose above the operator's work station, i.e., to suspend the hose above the floor or bench where the feedstock reservoir is located. Further the molten feedstock reservoir may be itself positioned above the operator's work station; such allows the operator to move around the floor space adjacent to and within his work station without being hindered in any way by the molten feedstock supply source.

As earlier mentioned, the adhesive gun should preferably have total freedom of movement in production line situations. This for the reason that the operator must be able to direct the hand gun's nozzle into nooks and crannies of an assembly or subassembly so as to deposit the hot melt adhesive in the exact location required to accomplish the desired bonding result. That is, and in the most preferred situation, an adhesive gun should be exactly in the nature of a hand gun in the sense that same should not be connected with any feedstock supply or power source at all; this would allow the operator to manipulate the gun into whatever spatial orientation is desired by the operator, or is required because of the structural configuration of the workpiece, so as to achieve optimum results. However, and in the case of all hot melt adhesive gun structures known to the art, same must be connected to a molten feedstock supply source by a feed hose and/or to a power source by a power cord, so orientation of the gun in that manner desired by the operator is limited to the extent that the gun itself is connected to at least one source. Of course, and even with the adhesive gun so connected, it is highly desirably that the operator have as much freedom in use of the gun as is possible to facilitate production efficiency and to prevent overtiring of the operator.

For example, in use of that type hand gun which receives molten feedstock through a feed hose, the optimum position of the gun's handle vis-a-vis the gun's barrel and feed hose has been found to vary depending on whether the molten feedstock reservoir is located on ground level or on a bench next to the operator's work station or whether the feed hose is suspended above the operator's work station. This for the reason that when the molten feedstock reservoir is positioned on the floor, the optimum gun handle position from an operator's standpoint is different than when the feed hose is suspended from above the operator's work station. In other words, and to facilitate use of this type adhesive gun by an operator, it has been found desirable to provide a handle structure that can be set in a first location when the molten feedstock reservoir is positioned on floor level, and at a second location when the feed hose is suspended from above the operator's work station. Such is advantageous in that it tends to ward off the tiring of an operator's arm and hand muscles, i.e., in that it aids the operator to maintain optimum work efficiency for a longer period of time.

Accordingly, it has been one objective of this invention to provide a hand-held type adhesive gun adapted to discharge molten thermoplastic materials, that gun having a novel handle structure movable about the gun barrel's axis between at least two fixed positions.

It has been a further objective of this invention to provide a handle structure for an adhesive gun movable between at least two fixed operating positions, that handle structure incorporating a first port in its foot, and a second port adjacent the gun's barrel, the gun's power cord passing through one of the ports depending on the orientation of the handle to aid as much as possible in keeping that power cord out of the operator's way.

Another objective of the invention is to provide a novel heat exchanger located adjacent the discharge nozzle of a molten adhesive dispenser, the heat exchanger raising the temperature of the molten adhesive to an elevated application level from a reduced supply level just prior to dispensing the adhesive onto a substrate.

In accord with these objectives, the novel handle structure for an adhesive gun of this invention is positioned at the aft end of the gun's barrel, and has a longitudinal axis extending rearwardly of the gun's barrel and located at an acute angle relative to the longitudinal axis of the gun's barrel. The gun's handle is positionable about the gun barrel's longitudinal axis between at least two operating locations, one being positioned 180° from the other. A gun control switch is mounted interiorly of the handle, the switch being mechanically operated by the gun's trigger. At least two ports are provided in the handle, one at the foot of the handle and the other adjacent the gun's barrel, the power cord that interconnects with the gun control switch being receivable into the handle through either port depending on the use orientation of the handle. Further in accord with these objectives, the novel heat exchanger device includes a heat exchanger core fixed in location within a heater body's bore. The heat exchanger core has spiral threads on the outer surface thereof, and the bore's surface has spiral threads thereon, too. The heat exchanger core's threads are sized relative to the inlet bore's threads such that the core can be threaded into the bore, and such that the threads cooperate to define a spiral path about the core through the bore from one end to the other, thereby defining a spiral heat exchange path through the gun's heater body.

Other objectives and advantages of this invention will be more apparent from the following detailed description taken in conjunction with the drawings in which:

FIG. 3 is a partial diagrammatic electrical circuit showing the relationship of the gun's power cord to the molten feedstock reservoir;

THE ADHESIVE GUN

Figure 5:
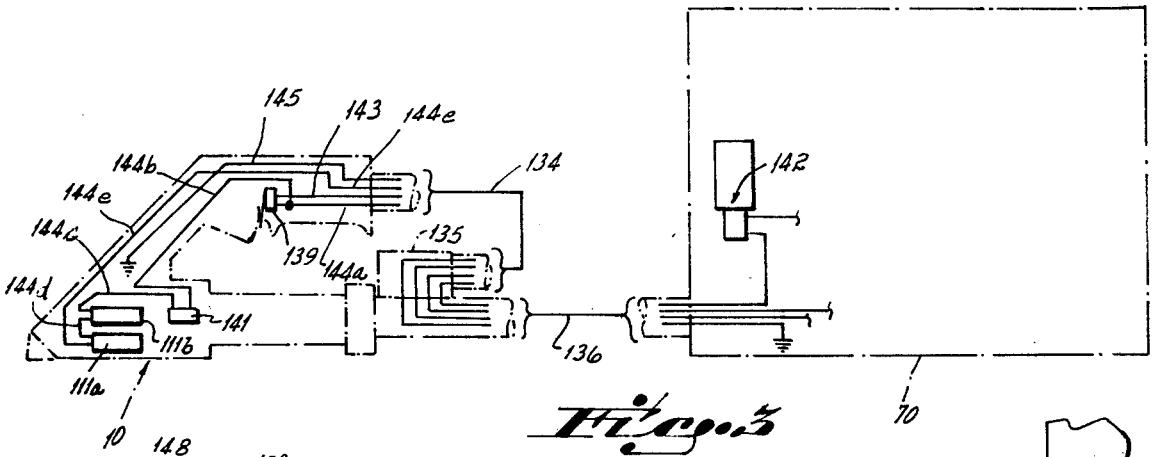
FIG. 5 is a cross-sectional view taken along line 5—5 of FIG. 2, same showing a second heat exchanger embodiment in detail.

The structure of adhesive gun 10 is particularly illustrated in FIGS. 4—9. As shown in those Figures, the gun's housing 11 is fabricated of two shell halves 11*a*, 11*b*, same being substantially mirror images one of the other. The two shell halves 11*a*, 11*b* are joined together by bolts 12*a*, 13*a* and 12*b*, 13*b* threaded into heater body 14, thereby forming the housing 11 and locating the heater body within that housing (see FIGS. 4 and 8). The gun housing 11 is configured to define a barrel portion 15 having longitudinal axis 16, and an adhesive feed portion 17 having longitudinal axis 18, in a vaguely Y-shaped configuration. Likewise, the one-piece heater body 14 includes a barrel portion 19 coaxially disposed with the longitudinal axis 16 of the housing's barrel portion 15, and an adhesive feed portion 20 coaxially disposed with the longitudinal axis 18 of the housing's adhesive feed portion 17. The handle structure 21 (described in detail below) extends rearwardly from the aft end of the housing's barrel 15.

Figures 4, 6:
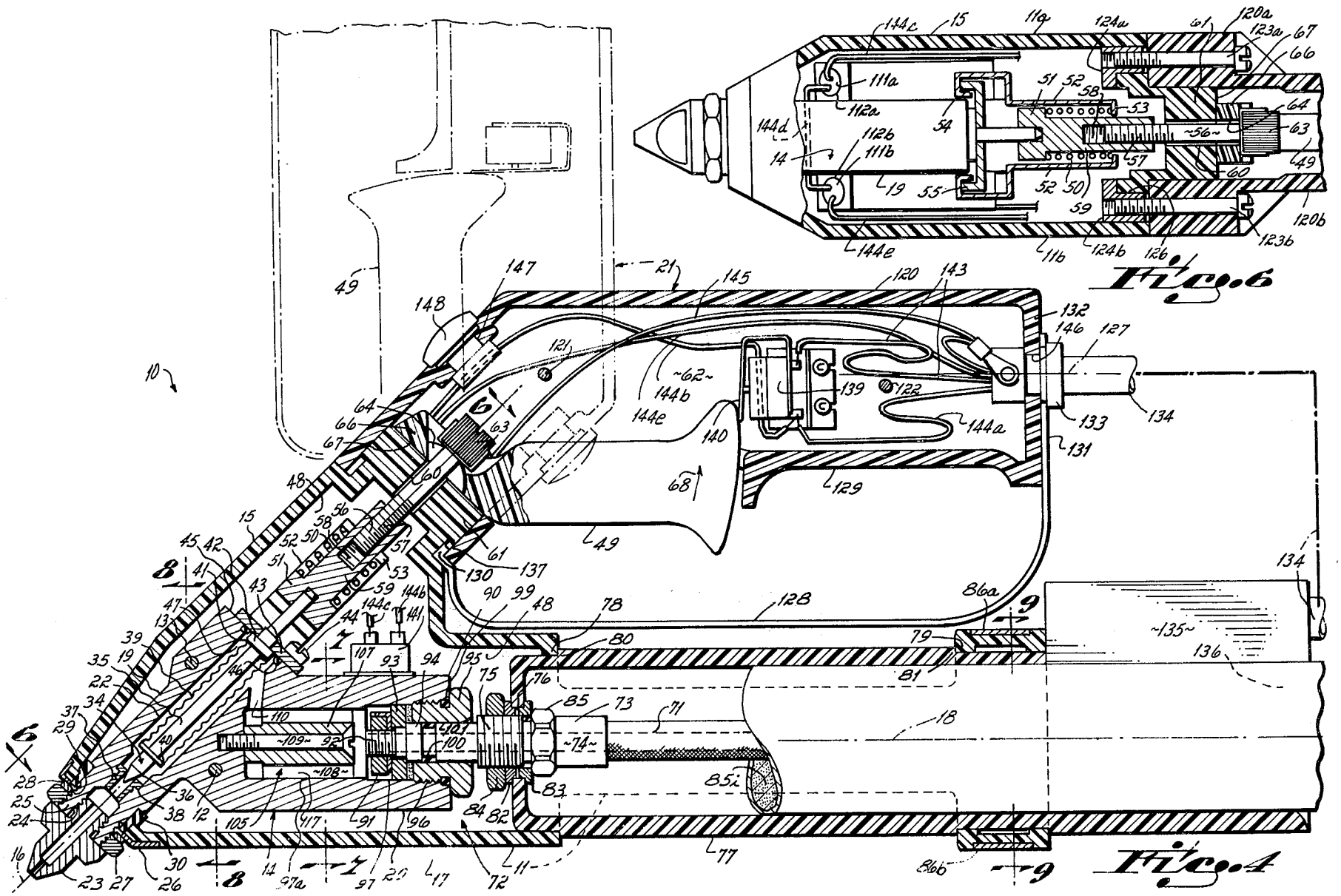
FIG. 4 is a cross-sectional view taken along line 4—4 of FIG. 1, same showing a first heat exchanger embodiment in detail.
FIG. 6 is a cross-sectional view taken along line 6—6 of FIG. 4.

The barrel portion 19 of the heater body 14 (which is fabricated of a heat conductive material) defines a bore 22 coaxially aligned with longitudinal axis 16 of the housing's barrel 15, see FIGS. 4 and 5. This bore 22 is the discharge bore for the hot melt adhesive. A nozzle 23 is threaded, as at 24, into the interior of the discharge bore 22 at the discharge end of the gun 10. The discharge end 25 of the heater body 14 is retained in fixed location relative to cover cone 26 of the housing 11 by nut 27 and washer 28, the nut being threaded, as at 29, onto the heater body. An insulator ring 30 is interposed between the heater block's discharge end 25 and the housing 10 to insulate the housing from the hot heater body during operation of the gun.

A discharge valve 34 is positioned within the discharge bore 22 interiorly of the heater body 14, see FIGS. 4 and 5. The discharge valve 34 includes a valve stem 35 and a valve head 36 fixed thereto, the stem being coaxially disposed within the discharge bore 22. The valve head 36 is adapted to seat against valve seat 37 in sealing fashion, the valve seat being press fit into the bore 22 against shoulder 38. A seal in the nature of a compressible bellows 39 is fixed at one end 40 to the valve stem 35 adjacent the valve head 36, and is fixed at the other end 41 to washer 42 (the valve stem 35, therefore, is reciprocable through the washer). The washer 42 is held in fixed location within the discharge bore 22 by retainer plate 43 bolted by screws 44 to aft end face 45 of the heater body 14. O-ring 46 seals that end 47 of the discharge bore 22 off from the interior 48 of the housing 11. The bellows 39 functions to allow longitudinal movement of the valve stem 35 while maintaining a seal to prevent leakage of molten adhesive feedstock from discharge bore 22 through the aft end 47 of that bore into housing interior 48, thereby permitting valve head 36 and valve seat 37 to function as a discharge valve 34 as permitted by the trigger 49 (described in detail below). The discharge valve 34 assembly is hydraulically unbalanced such that the the valve head 36 and stem 35 will move rearwardly due to the hydraulic pressure of molten feedstock in the discharge bore 22 (as viewed in FIGS. 4 and 5) when the trigger 49 is activated by an operator. This, of course, allows the molten adhesive feedstock to be discharged through the nozzle 23.

The gun's trigger 49 is adapted to cooperate with spring 50 loaded against a stop 51. The trigger 49 functions only to withdraw the stop 51 against the compression spring 50 bias, thereby allowing the discharge valve to open due to hydraulic pressure only of the molten feedstock (as previously described). The stop 51 is slidingly received in bracket 52, the bracket being positioned in fixed engagement with the retainer plate 43 by virtue of compression spring 50 bearing against the underside of that bracket's crown 53, and bracket feet 54 curling around the retainer plate's flange 55. Because of this structure, compression spring 50 forces stop 51 continuously against valve stem 35, thereby continuously biasing the valve head 36 toward the discharge valve 34 closed attitude (shown in FIGS. 4 and 5) where the valve head is seated on the valve seat 37. An adjusting bolt 56 is threaded, as at 57, into interior bore 58 defined in the stop's shaft 59, that adjustment bolt extending through port 60 in the aft end of the gun housing's barrel portion 15 into the interior 62 of handle 21. By rotating bolt 56, the compression on spring 50 is increased or decreased as desired, thereby adjusting the finger pressure required to operate the trigger 49.

The trigger 49, which is carried within the gun's handle 21, includes a thumb 66 that defines an elongated slot 64 through which the adjustment screw 56 passes, the adjustment screw's head 63 causing the trigger's thumb 66 to be captured between the screw 56 and the lever face 67 at the aft end 61 of the housing's barrel 15. When the trigger is pulled upwardly (as shown by directional arrow 68 in FIGS. 4 and 5) by an operator's index finger, the trigger's thumb 66 bears against lever face 67, thereby causing the stop 51 to be drawn rearwardly against the bias of the compression spring 50 so that the discharge valve 34 can open in response to the hydraulic pressure of the molten feedstock in discharge bore 22. When the operator releases the trigger 49, compression spring 50 moves the stop 51 into abutting contact with the valve stem 35, thereby closing the discharge valve 34 since the compression spring pressure overcomes the molten feedstock's hydraulic pressure.

Figure 1:
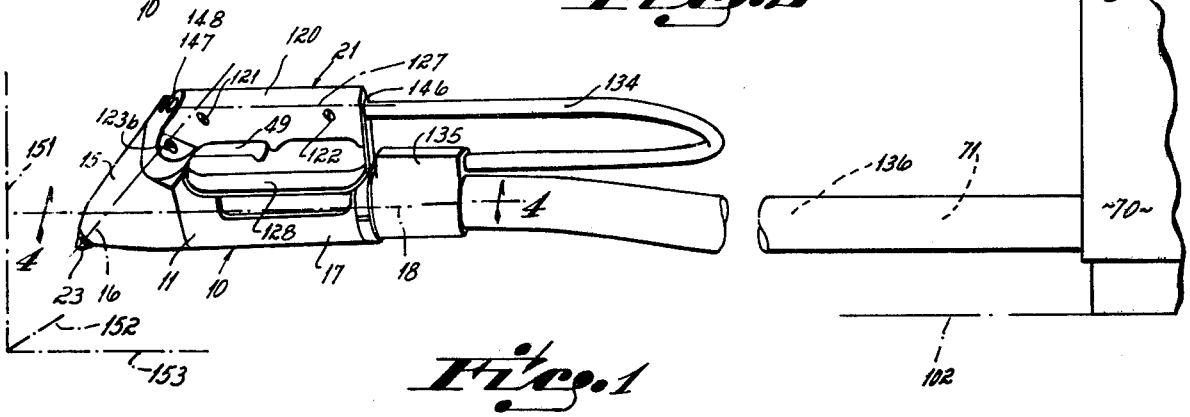
FIG. 1 is a perspective view of an adhesive gun utilizing the novel handle structure of this invention, a molten feedstock reservoir being shown on a work surface level and the gun's handle being shown in first position.
Figure 2:
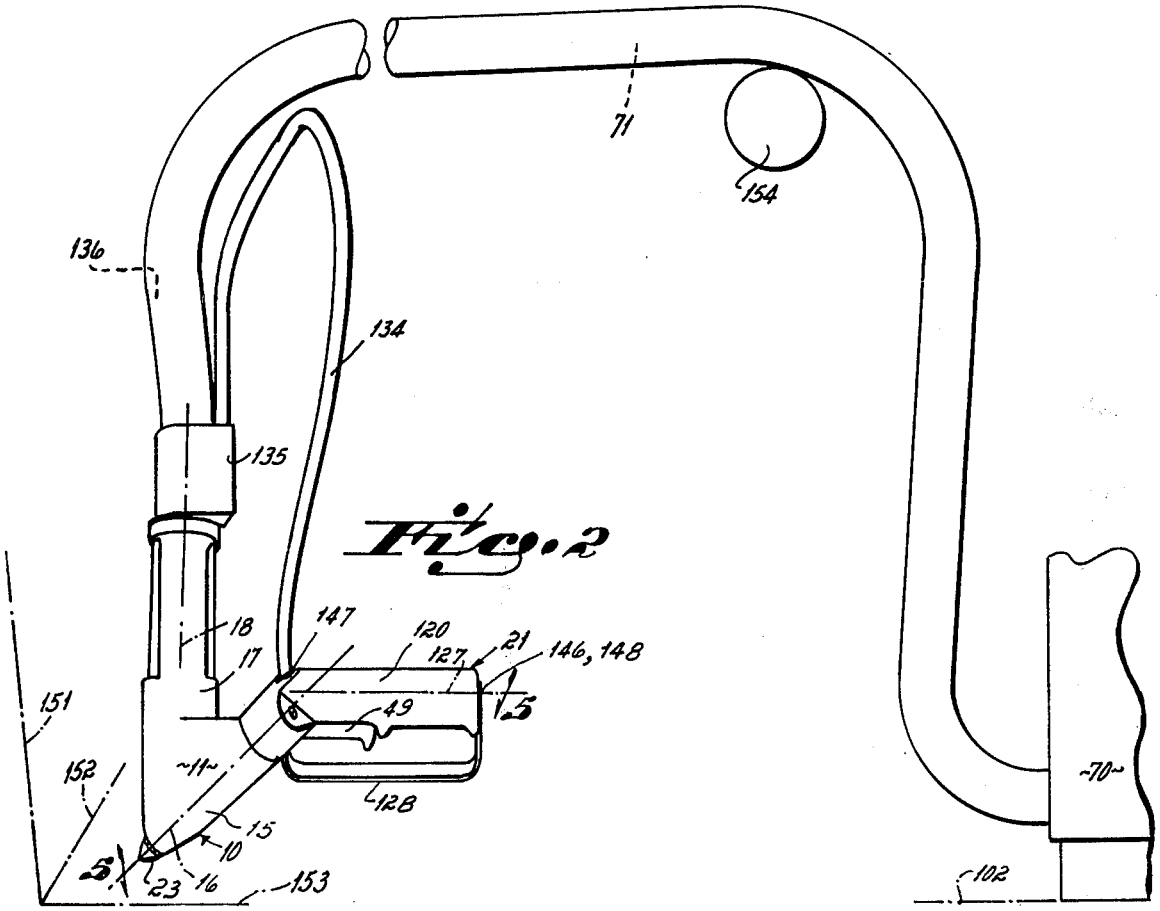
FIG. 2 is a view similar to FIG. 1 but with the reservoir being shown at an elevated position above ground level and the handle structure being shown in a second position.

The hot melt adhesive gun 10 illustrated in the Figures is of that type where the thermoplastic feestock is translated from the solid to molten state in a supply source housing 70, i.e., at a molten feedstock reservoir. Such is accomplished by means of apparatus such as is illustrated in U.S. Pat. No. 3,827,603 issued Aug. 6, 1974, and U.S. Pat. No. 3,815,788 issued June 11, 1974, both assigned to the assignee of this application. The molten feedstock in the supply source housing 70 must, of course, be transmitted to the gun's housing 11. This is accomplished by means of a hot melt hose 71 connected at one end to the reservoir 70, and connected at the other end through a rotatable joint 72 to the heater body 14. The rotatable joint 72 aids the operator in orienting the gun 10 to the desired operational attitude without unduly kinking or coiling the feed hose 71, and at minimum effort. As illustrated in FIGS. 1 and 2, the reservoir 70 may be positioned on floor 102 or on a workbench or otherwise adjacent to the operator's work station. As shown in FIG. 1, the hot melt feed hose 71 may extend direct to a workpiece (indicated by phantom lines 151–153) from the reservoir. As shown in FIG. 2, the hot melt feed hose 71 may also be directed over an elevated roller bar 154 within the operator's work station so that the feed hose 71 extends substantially vertically downward into the operator's work station into proximity with the workpiece (indicated by phantom lines 151–153). Whether the hose 71 extends from the reservoir 70 directly to the workpiece 151–153 as shown in FIG. 1, or indirectly to the workpiece 151–153 over roller bar 154, depends to some extent on the character of the workpiece and the personal work habit desires of the operator.

Figures 5, 7, 8, 9:
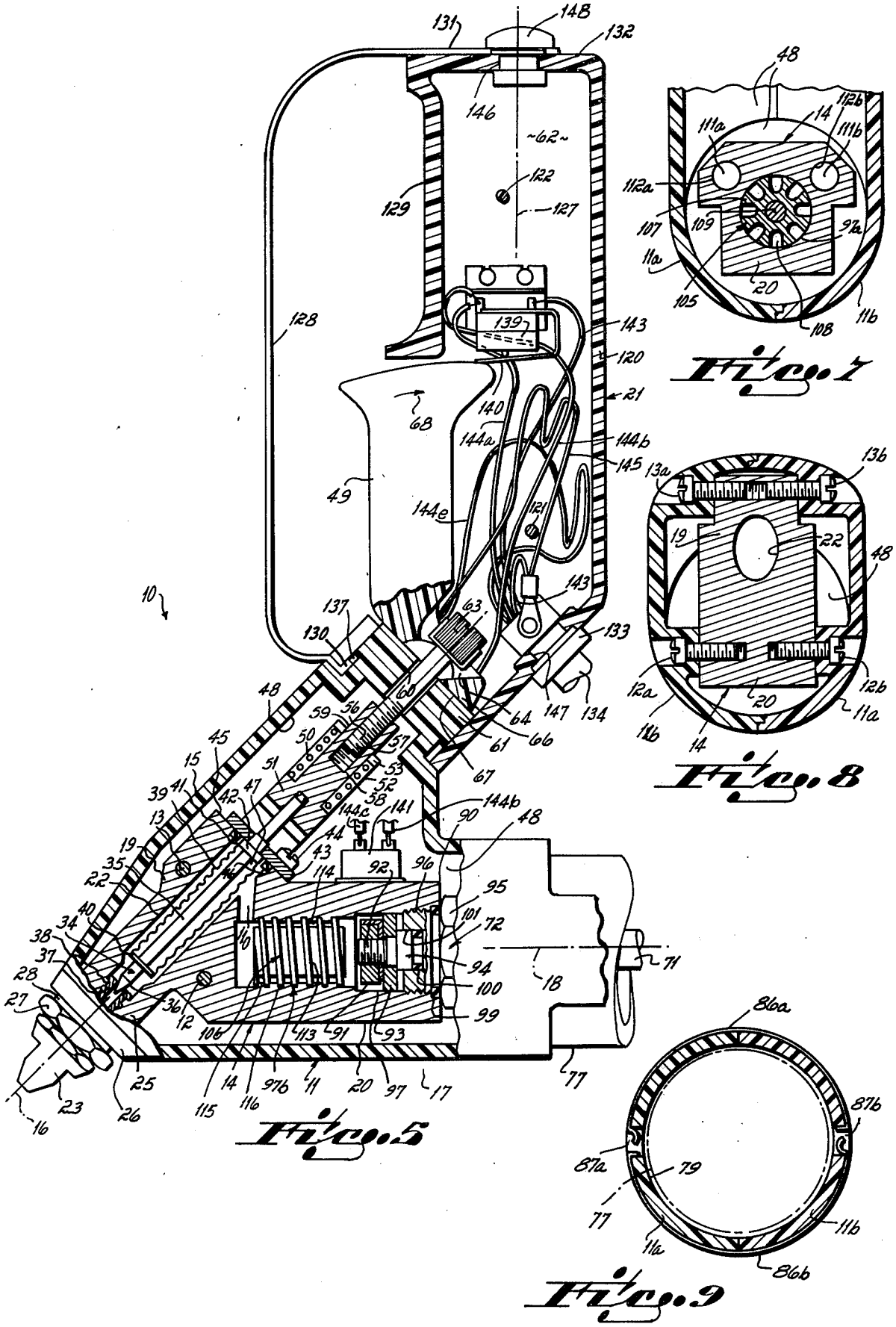
FIG. 7 is a cross-sectional view taken along line 7—7 of FIG. 4.
FIG. 8 is a cross-sectional view taken along line 8—8 of FIG. 4.
FIG. 9 is a cross-sectional view taken along line 9—9 of FIG. 4.

The flexible hot melt feed hose 71, at the gun end 73 of the hose, terminates in a rigid connector pipe 74 partially threaded as at 75 on the exterior surface thereof, see FIGS. 4 and 5. Threaded portion 75 of the connector pipe 74 passes through port 76 at the inner end of hose sleeve 77, and is separated therefrom by insulator rings 82, 83. The hose sleeve 77 is captured between the housing's shell halves 11*a*, 11*b* by housing ribs 78, 79 which cooperate with annular shoulders 80, 81 formed in the hose sleeve, and is sized so as to be rotatable relative to the housing's shell halves. As shown in FIGS. 4 and 9, the hose sleeve 77 (and, hence, the feed hose 71) is received coaxially into the gun housing's adhesive feed portion 17 with opposing shell halves 11*a*, 11*b* of the housing being restrained in fixed relation with one another at the aft end of that portion by metal bands 86*a*, 86*b* that snap fit into dimples 87*a*, 87*b* formed in the housing. Lock nut 84 cooperates with hex head 85 fixed to the connector pipe 74 to trap the gun end of the hose sleeve 77 between the insulator rings 82, 83, thereby locating the hose sleeve in fixed position relative to the feed hose 71 itself. Of course, the space between the feed hose 71 itself and the hose sleeve 77 is filled as at 85-*i* with insulation to maintain the thermoplastic feedstock in the molten state, as well as to reduce the temperature at the surface of the hose sleeve for safety purposes.

The connector joint 72, which permits the gun 10 to rotate relative to the feed hose 71 and hose sleeve 77, interconnects the feed hose with the aft end 90 of the heater body's adhesive feed portion 20, see FIGS. 4 and 5. The rotatable joint 72 includes a lock nut 91 fixed to the threaded end 92 of connector pipe 74, thereby trapping a sealing ring 93 between the lock nut and boss 94 formed on the connector pipe. A T-shaped restrainer nut 95 is threaded, as at 96, into inlet bore 97 of the heater body 14 at the aft end 90, thereby restraining the feed hose 71 in fixed longitudinal relation with the heater body. The gun 10 is rotatable relative to feed hose 71 because connector pipe 74 is rotatable within T-nut 95. O-ring 99, interposed between the T-shaped nut 95 and the heater block's inlet bore 97, and O-ring 100 interposed between the connector pipe 74 and the T-nut's bore 101, form a seal-tight relationship between the inlet bore 97 of the heater body 14 and the interior 48 of the gun's housing 11.

The hot melt adhesives, e.g., "VERSALON 1200", a polyamide resin manufactured by General Mills Chemicals, Inc., used for product assembly have a tendency to char or degrade rapidly when subjected to high temperatures for long periods of time. However, it is necessary to apply the adhesives at a high temperature in order to achieve sufficient wetting of the surfaces of the materials being bonded together; this is necessary to achieve a strong bond. Thus, it is desirable to supply a molten adhesive to the adhesive gun 10 through supply hose 136 at a reduced temperature, and raise the temperature of the molten adhesive within the gun's housing 11 to an elevated level, i.e., to the desired application level, just prior to dispensing the adhesive from the gun onto a substrate.

Prior art devices, as illustrated in U.S. Pat. No. 3,408,008 issued on Oct. 29, 1968 to E. H. Cocks for "Apparatus for Applying Hot Melt Adhesives" utilize a heat exchanger which is located immediately adjacent to the melter where the adhesive is initially melted from a solid to a molten condition, thereby maintaining the temperature of the adhesive at a high temperature as it is pumped from the fluid reservoir through the heated hose and the gun. By maintaining that high temperature throughout the entire system, the adhesive is subjected to that undesirable high temperature for a substantial period of time and, therefore, chars or degrades. An adhesive that has degraded cannot achieve a strong bond between the materials being bonded together.

Applicants have solved the problem previously stated by converting the adhesive from a solid state to a pumpable molten state in the reservoir 70. The adhesive is heated to the degree or condition (e.g., 450° F. for VERSALON 1200) where it becomes sufficiently liquid that it may be pumped, but not to a degree or condition where the adhesive will char or degrade. The adhesive is maintained in that reduced temperature condition as it is pumped from the reservoir 70 through the heated hose 136 into the inlet 97 of the adhesive gun 10.

After the hot liquid adhesive has been brought up to the desired application temperature by flowing through the heat exchanger core 105 (or 106 as discussed below), it has a very short flow path via bores 110 and 22 through nozzle 23. This permits the adhesive to be maintained at the necessary elevated application temperature (e.g., 550° F for VERSALON 1200) for a minimum residence time prior to being dispensed through the nozzle 23. Therefore, degredation of the adhesive is maintained at a minimal acceptable level.

A heat exchanger core 105 or 105 is seated in the heater body's feedstock inlet bore 97, this inlet bore being coaxially aligned with the longitudinal axis 18 of the housing's feed inlet portion 17 (compare FIGS. 4 and 5). As shown in FIGS. 4 and 7, one embodiment 105 of such a heat exchanger is in the nature of a cylinder 107 having a fluted (as at 108) exterior side wall surface, that cylinder being slidably disposed in a circular bore 97*a* coaxially aligned with the inlet hose 71. The heat exchanger core 105 is fixed within the heater body 14 by screw 109. A transfer bore 110 interconnects the heater body's discharge bore 22 and the heater body's inlet bore 97 (the heat exchanger core 105 being positioned within the inlet bore) so as to provide a continuous path for the molten feedstock from the hot melt feed hose 71 to the gun's discharge nozzle 23. Heater cartridges 111*a*, 111*b* (see FIG. 7) are disposed parallel to the longitudinal axis 18 of both heat exchanger core 105 or 106 in separate bores 112*a*, 112*b* located on opposite sides of the inlet bore 97*a* within the heater body 14, thereby providing heater means which can raise the temperature of the heater body and adhesive feedstock to the desired application temperature just prior to dispensing it; approximately 550° F for VERSALON 1200. This novel heat exchanger is particularly adapted to elevate the temperature of the molten adhesive, just prior to dispensing it, above that temperature level at which the adhesive is supplied to the hand gun.

Another embodiment 106 of the heat exchanger is illustrated in FIG. 5. In this alternative embodiment (which also makes use of heater cartridges 111) the interior periphery of the inlet bore 97*b* is provided with acme type threads, as at 116. Likewise, the heat exchanger core 106 itself is provided with exterior acme type threads as at 113. However, the root depth of the threads 113 on the exterior surface of the heat exchanger core 106 is substantially greater than the height of the threads 112 on the inner surface of the inlet bore 97*b* even though the thread diameters are approximately the same. The heat exchanger core 106 is, in effect, screwed into the heater body's inlet bore 97*b*, and when in position as illustrated in FIG. 5 there is a spiral path defined between the heat exchanger core and the inlet bore's surface 115. Thus, and in this alternative heat exchanger embodiment, the hot melt adhesive is forced to traverse a spiral path 114 through the inlet bore 97*b* prior to reaching the discharge bore 22, thereby insuring a very even temperature gradient for the molten feedstock. In the heat exchanger embodiment illustrated in FIG. 4, the molten feedstock simply passes through the heat exchanger in a series of separate straight line paths 117 defined by flutes 108 that are aligned parallel to the axis 18 of the heater body's inlet bore.

HANDLE STRUCTURE

The handle 21 for the adhesive gun 10 is also illustrated in FIGS. 4–5, and the use positions of the handle vis-a-vis the location of reservoir 70 for the molten feedstock is shown in FIGS. 1 and 2. The handle 21 structure is comprised of two substantially mirror image housing halves 120*a*, 120*b*, same being held together in assembled form by bolts 121, 122. The handle housing 120 is fixed to the gun housing's barrel 15 by bolts 123*a*, 123*b* threadedly engaged with nut inserts 124*a*, 124*b* press fit into inner annular groove 126 formed at the aft end of the gun's barrel. Note particularly that the handle 21 has two operating positions, one being shown in FIGS. 1 and 4 with the longitudinal axis 127 of the handle disposed parallel to the longitudinal axis 18 of the housing's adhesive feed portion 17, and the other being shown in FIGS. 2 and 5 with the handle's longitudinal axis 127 disposed perpendicular to the longitudinal axis 18 of the housing's adhesive feed portion 17. In this regard, too, note that in the first position as shown in FIG. 1 the handle 21 extends rearwardly from the aft end 61 of the gun's barrel 15 and is disposed at an acute angle of about 45° relative to the longitudinal axis 16 of the gun's barrel. Likewise, and in the second position as shown in FIG. 2 where the handle 21 is disposed at 180° from the first position, the handle also extends rearwardly from the aft end 61 of the gun's barrel 15 at an acute angle of about 45° relative to the longitudinal axis 16 of the gun's barrel 15. The first or FIG. 1 position has been found particularly useful for an operator when the hot melt adhesive supply source 70 is disposed at a surface level 102 adjacent the operator's work station. The second or FIG. 2 position of the gun's handle has been found particularly useful for an operator when the hot melt adhesive supply source 70 is suspended above the surface level 102 at the operator's work station. Movement of the handle 21 from the FIG. 1 position to the FIG. 2 position, and vice versa, is accomplished simply by removing bolts 123*a*, 123*b* from interengagement with nut inserts 124*a*, 124*b* carried in the gun housing's barrel 15, thereby permitting the handle to swing between its respective positions. Of course, when the new position has been attained, bolts 123*a*, 123*b* are threadedly engaged once again with the nut inserts 124*a*, 124*b* to fix the handle structure back to the gun's housing 11.

The handle 21 structure includes a configured hand guard 128 adapted to protect the finger grip portion 129 of the handle, the gun's trigger 49 being located in the handle so as to be also protected by that hand guard, see FIG. 4. Finger 130 of the hand guard 128 is trapped in groove 137 between the handle's housing 121 and the gun housing's aft end 61 when the handle 21 structure is fixed to the gun's housing 11, and foot 131 of the hand guard is fixed to the foot 132 of the handle's housing 120 by bushing 133. Bushing 133 also serves as a bushing for secondary power cord 134.

As illustrated in FIGS. 3 and 4, the gun's electrical circuitry includes a junction box 135 mounted on the hose sleeve 77 adjacent the aft end of the gun housing's feed hose portion 17. A primary electrical power cord 136 is carried by the hose sleeve 77 from the hot melt adhesive reservoir 70 to the junction box 135. A secondary electrical power cord 137 is then interconnected with the junction box 135 at one end, and is introduced into the handle's interior 62 at the other end through bushing 133. A microswitch 139, fixed in place within the interior 62 of the handle 21, includes a switch arm 140 adapted to be depressed by trigger 49 when that trigger is pulled or activated by the operator, and released when the trigger is released by the operator. The electrical circuitry also includes the heater cartridges 111*a*, 111*b* in location within the heater body 14, and a thermostat 141 fixed to the heater body. The microswitch 139, the thermostat 141, the heater cartridges 111, and a solenoid 142 within the reservoir housing 70, are all electrically connected. More particularly, and as shown in FIGS. 3, 4 and 5, the secondary power cord includes microswitch lead 143, main circuit lead 144*a–e* which connects the microswitch 139, the thermostat 141, and both heater cartridges 111 in series, and ground lead 145 fixed onto the heater body 14. Hence, activation of the trigger by an operator causes molten feedstock to flow from the reservoir 70 to the gun 10. Further, and if the heater body 14 is at a less than desired temperature as sensed by the thermostat 141, activation of the electrical resistance heater cartridges 111 will heat the heater body 14 for purposes of maintaining the molten feedstock at the desired temperature in the gun 10 prior to discharge.

As shown in FIG. 4, and when the handle 21 is disposed in that operational attitude where the longitudinal axis 127 of same is parallel to the longitudinal axis 18 of the housing's feed portion 17, it is most convenient for the secondary power cord 137 to enter the handle's interior 62 through power cord port 146 in the foot 132 or base thereof. This keeps the secondary power cord 137 loop (see FIG. 1) substantially adjacent to the hose sleeve 77, i.e., substantially out of the way of the operator. Note power cord port 147 disposed in the handle's housing 120 immediately adjacent the aft end 61 of the gun's barrel 15, i.e., at the top of the handle. When the secondary power cord 137 is disposed as illustrated in FIG. 4, plug 148 is provided in that port 147 to seal off the interior 62 of the handle 21 from the atmosphere.

When the handle 21 has been transferred from the FIG. 1 and 4 location to the FIG. 2 and 5 location, such as would normally be the case if the adhesive supply reservoir 70 is elevated above the operator's work station as shown in FIG. 2, the entry location of the secondary power cord 137 into the handle's interior 62 is repositioned. That is, the combination of the secondary power cord 137 and bushing 133 are removed from the port 146 in the handle's base 132, and transferred to the port 147 adjacent the gun barrel's aft end 61. The plug 148 is transferred to the lead port 146 in the handle's foot 132 so as, once again, to close off the interior 62 of the handle 21 from the gun's environment. In this new location, once again the secondary power cord 137 is retained substantially parallel to the feed hose 71 which is now vertically oriented since the hot melt adhesive reservoir 70 is positioned above the operator's work station. Transfer of the secondary cord 137 and bushing 133 is achieved by removing the handle halves 120*a*, 120*b* from fixed relation one with the other (by removing bolts 121, 122) and from fixed relation with the gun's housing 11 (by removing bolts 123*a*, 123*b*), and thereafter reseating the bushing 133 (with power cord 137) in one of the ports 146 or 147 and the plug 148 in the other of those ports, thereby trapping same in fixed location relative to the handle 21.

Having described in detail the preferred embodiment of our invention, what we desire to claim and protect by Letters Patent is:

1. A hand gun adapted to discharge molten adhesive feed-stock as desired by an operator, said gun comprising a gun housing having a barrel portion and an adhesive feed portion, the longitudinal axes of said barrel and adhesive feed portions being oriented at an acute angle relative one to the other, a heater body positioned within said gun housing, said heater body including at least one heater cartridge thermostatically controlled to maintain the molten adhesive feedstock within said gun at the desired temperature level, a discharge valve positioned within said gun housing and connected with said heater body, said discharge valve being operable by an operator to control discharge of said molten adhesive feedstock, a handle fixed to one of said housing's portions at the aft end thereof and extending rearwardly thereof, said handle being located in one of first and second mount locations as selected by said operator, connector means that mount said handle to that one of said housing's portions in fixed relation therewith, said connector means being operable to allow swinging of said handle about the longitudinal axis of that one of said housing's portions from said first mount location generally normal to the longitudinal axis of the other of said housing's portions to said second mount location generally parallel to the longitudinal axis of the other of said housing's portions, said second mount location being substantially 180° removed from said first mount location, and said handle's longitudinal axis being oriented at a generally acute angle relative to the longitudinal axis of that one of said housing's portions at both mount locations.

2. A hand gun as set forth in claim 1 including structure defining a first power cord port at the base of said handle, structure defining a second power cord port adjacent the top of said handle, said power cord being admitted to the interior of said handle through that port which makes use of said gun easiest for the operator, and a plug mounted in that port which does not receive said power cord to close off the handle's interior from the atmosphere.

3. A hand gun as set forth in claim 1 including a trigger mounted to said handle, said trigger being adapted to activate said discharge valve, and a switch mounted within said handle, said trigger also being adapted to activate said switch, said switch being interconnectable with a reservoir source remote from said gun for supplying adhesive feedstock to said gun.

4. A hand gun as set forth in claim 1 including a feed hose interconnectable with a reservoir, and a rotatable joint that interconnects said feed hose and said discharge valve, thereby permitting said gun to rotate relative to said feed hose.

5. A hand gun as set forth in claim 4 wherein said acute angle is about 45° at both locations.

6. A hand gun as set forth in claim 1 including a finger guard fixed in place to said handle, said finger guard being located between said handle and said adhesive feed portion when said handle is positioned in said second mount location.

7. In a hand gun of the type adapted to discharge a molten adhesive feedstock when desired by an operator, said hand gun including a discharge valve within said gun housing's barrel for controlling discharge of said feedstock, the improvement comprising a handle fixed to said barrel at the aft end thereof and extending rearwardly thereof, connector means that mount said handle to said barrel in operational relation therewith, said connector means being adjustable to allow repositioning of said handle from a first mount location to a second mount location, said handle's longitudinal axis being oriented at a generally acute angle relative to said barrel's longitudinal axis at both locations, structure defining a first power cord port at the base of said handle, structure defining a second power cord port adjacent the top of said handle, said power cord being admitted to the interior of said handle through that port which makes use of said gun easiest for the operator, and a plug mounted in that port which does not receive said power cord to close off the handle's interior from the atmosphere.

8. An improvement as set forth in claim 7 including a trigger mounted to said handle, said trigger being adapted to activate said discharge valve, and a switch mounted within said handle, said trigger also being adapted to activate said switch, said switch being interconnectable with a reservoir source remote from said gun for supplying adhesive feedstock to said gun.

9. An improvement as set forth in claim 7 including a feedstock inlet housing portion fixed to said gun's housing, said inlet housing portion extending from said gun's barrel rearwardly of the gun's discharge nozzle and at an acute angle relative to said barrel, a feed hose interconnectable with a reservoir, and a rotatable joint that interconnects said feed hose and said discharge valve, thereby permitting said gun to rotate relative to said feed hose.

10. An improvement as set forth in claim 9, wherein said handle's longitudinal axis is generally parallel to said feed-stock housing's longitudinal axis in said first location, and is generally perpendicular thereto in said second location.

11. An improvement as set forth in claim 9 wherein said acute angle is about 45° at both locations.

* * * * *